US005778046A

United States Patent [19]

Molloi et al.

[11] Patent Number: 5,778,046

[45] Date of Patent: Jul. 7, 1998

[54] AUTOMATIC X-RAY BEAM EQUALIZER

[75] Inventors: Sabee Molloi, Laguna Beach; Jerry Tang, Irvine, both of Calif.

[73] Assignee: The Regents of the University of California, Oakland, Calif.

[21] Appl. No.: 588,814

[22] Filed: Jan. 19, 1996

[51] Int. Cl.[6] ..... G21K 3/00

[52] U.S. Cl. ..... 378/159; 378/156

[58] Field of Search ..... 378/156, 159

[56] References Cited

U.S. PATENT DOCUMENTS

| | | | |
|---|---|---|---|
| 3,755,672 | 8/1973 | Edholm | 378/159 |
| 4,497,062 | 1/1985 | Mistretta | 378/159 |

OTHER PUBLICATIONS

Peppler et al., "Digitally Controlled Beam Actuator," *SPIE* 347:106–111 (1982).

Hasegawa et al., "Feasibility of Selective Exposure Radiography," *SPIE* 454:271–278 (1984).

Plewes et al., "A Scanning Equalization System for Improved Chest Radiography," *Radiology*, 142(3):765–768 (1982).

Plewes, "A Scanning System for Chest Radiography with Regional Exposure Control: Theoretical Considerations," *Med. Phys.* 10(5)646–654 (1983).

Plewes et al., "A Scanning System for Chest Radiography with Regional Exposure Control: Practical Implementation," *Med. Phys.* 10(5):655–663 (1983).

Vlasbloem et al. "AMBER: A Scanning Multiple–Beam Equalization System for Chest Radiography," *Radiology* 169(1):29–34 (1988).

Edholm et al., "Primary X–Ray Dodging," *Radiology* 99(3):694–696 (1971).

Hasegawa et al., "Digital Beam Attenuator Technique For Compensated Chest Radiography," *Radiology* 159(2):537–43 (1986).

Hasegawa et al., "Geometrical Properties of a Digital Beam Attenuator System," *Med. Phys.* 14(1):314–21 (1987).

Boone et al., "Filter Wheel Equalization DSA: Simulation Results," *Med. Phys.* 20(2 Pt1):439–48 (1993).

Boone et al., "Filter Wheel Equalization In Chest Radiography: Demonstration With A Prototype System," *Radiology* 196(3):845–50 (1995).

Ersahin et al., "A Digital Filtration Technique For Scatter–Glare Correction Based On Thickness Estimation," *IEEE Transactions On Medical Imaging* 14:587–595 (1995).

Vyborny et al., "Foil Filters For Equalized Chest Radiography," *Radiology* 151(2):524 (1984).

*Primary Examiner*—Craig E. Church

*Attorney, Agent, or Firm*—Medlen & Carroll, LLP

[57] ABSTRACT

The present invention provides for an improved automatic x-ray beam equalizer. By analyzing an initial low dosage x-ray image of an object, an attenuation pattern can be calculated. An equalization pattern, generated from the attenuation pattern, can then be created in a mask and placed in the path of a full x-ray beam scan in order to properly attenuate the x-ray signal and create a clearer x-ray image of the object.

6 Claims, 4 Drawing Sheets

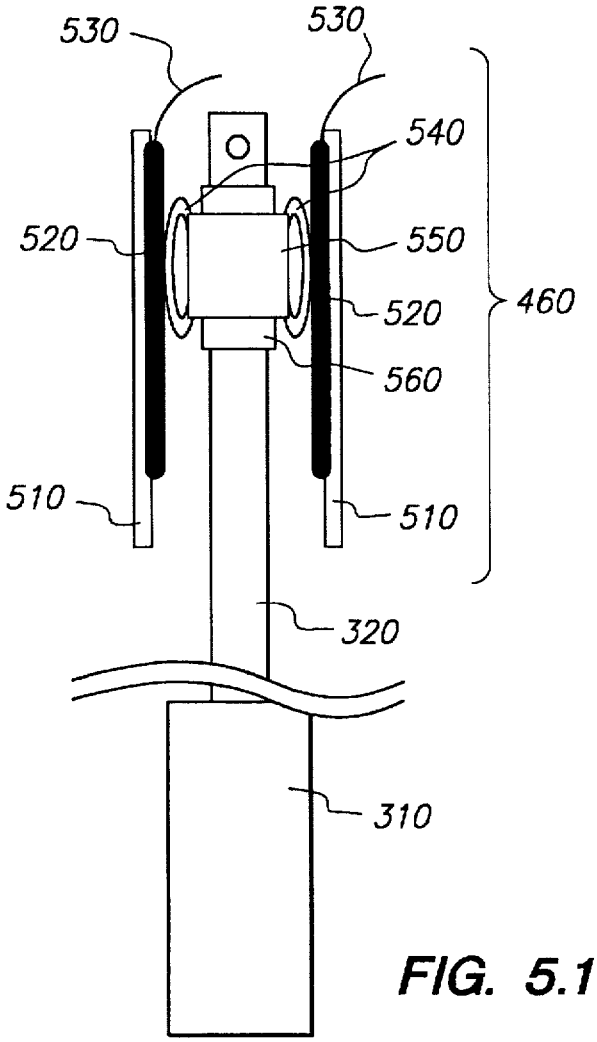
FIG. 5.1
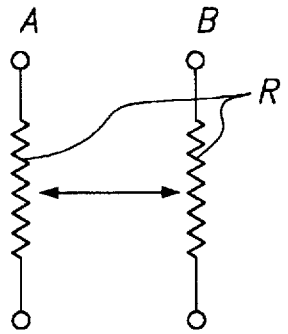
FIG. 5.2
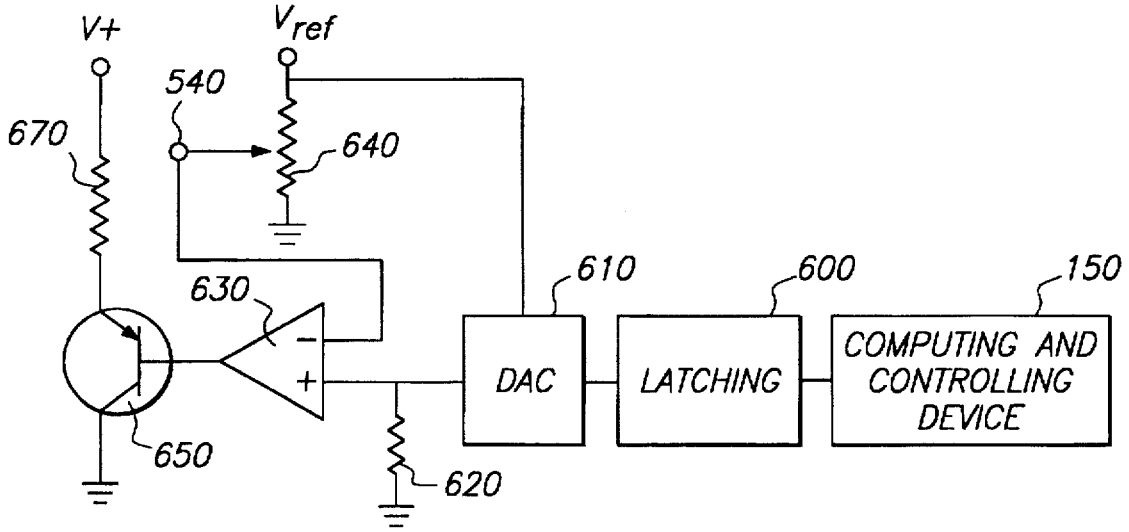
FIG. 6

AUTOMATIC X-RAY BEAM EQUALIZER

This invention was made with Governnent support under Grant Nos. R29HL42435 and R01-HL48030, awarded by the National Institutes of Health. The Government has certain rights in this invention.

FIELD OF THE INVENTION

This invention relates to the field of x-ray radiography. More particularly, this invention relates to equalization techniques for radiographic and fluoroscopic diagnostic x-ray systems.

BACKGROUND OF THE INVENTION

In conventional radiography, image quality and diagnostic value can be compromised when the object density differs drastically between different parts of an object. For example, in conventional chest x-rays the mediastinum and retrocardiac area can be underexposed, detracting from the diagnostic value of the image. In fact, many diagnostic errors in chest radiography occur in areas displayed with suboptimal contrast or penetration. Missed lung metastases, for example, can reside in these underexposed areas, camouflaged from view.

Equalization is a common term in the x-ray radiography field which refers to the process of selectively attenuating certain portions of the patient or object exposed to the x-ray. An x-ray radiographic image can be equalized by selectively attenuating only those areas of the image that are determined to have been overexposed. The effect of equalization is to reduce the intrinsically large dynamic range of the x-ray beam intensities in order to accommodate the dynamic range limitations of most x-ray detector systems. The most common detector systems employed in diagnostic x-ray radiography are film and image intensifier-TV systems, both of which have severely limited dynamic ranges.

Different methods have been presented to correct the problems described above. For example, one method involves arranging a plurality of filters between an x-ray emitter and the image receptor. The filters are selected and arranged so that only the areas of over-exposure are attenuated. Practice of this method provides acceptable results, once the correct combination of filters are found. However, a serious drawback of this method is that it is cumbersome since filter selection and juxtaposition is a manual process and can require time consuming trial and error for the correct combination to be found.

Another approach for addressing the above-described problem involves variably attenuating different portions of an x-ray beam by placing an attenuating material between an x-ray source and a patient. For example, one method is described in Peppler, et al., "Digitally Controlled Beam Attenuator," SPIE, 347:106–111, 1982. Peppler describes a digital beam attenuating device for attenuating specific areas of an imaged object. The device consists of an attenuation chamber which is placed between the x-ray tube and the patient. The chamber consists of a 6×6 array of 1 cm square lucite pistons each with a 1 cm stroke. An attenuating material of cerium chloride ($CeCl_3$) in solution is housed within a shapable latex membrane and placed in the path of the x-ray beam between the x-ray tube and the patient. A computer controls the advancement of the pistons which press into the membrane, adjusting the thickness of the $CeCl_3$ at certain cells. The degree of attenuation depends on the thickness of the $CeCl_3$. A solenoid controls water lines which control the advancement and retreat of the pistons. A reservoir is coupled to the latex membrane to catch overflowing solution when the membrane is compressed.

The most critical limitation with Peppler is that the empty digital beam attenuator reduces the primary x-ray attenuation by a factor of 15, which creates severe tube loading problems. Furthermore, Peppler utilizes a large number of dynamic elements such as the water lines and solenoids. These increase the chances of breakdowns, thereby increasing the costs of maintenance.

Another method is described in U.S. Pat. No. 4,497,062 to Mistretta (and a corresponding article: Hasegawa, B.H., Dobbins III, J.T., et al., "Feasibility of Selective Exposure Radiography," SPIE, 454:271–278, 1984). Mistretta describes a digitally-controlled x-ray beam method and apparatus. The apparatus comprises a computer which analyzes an initial x-ray image to locate high and low gray level regions. Based on this determination, an attenuation number for each pixel in the image is assigned and transmitted to a printer; such as a dot matrix or ink jet printer. A non-attenuating substrate is fed through the printer while the printer prints an attenuating pattern onto the substrate. The "ink" present on the ribbon contains attenuating material such as cerium oxide. The printer deposits the attenuating cerium in varying thicknesses depending on the attenuation number. The substrate is then placed between the x-ray source and the patient during a subsequent regular x-ray.

A major limitation of the technique proposed by Mistretta is the relatively long time required for custom fabrication of the compensation filter that precluded its clinical implementation. Specifically, it is described that the printing time of 80 layers of a 64×64 pixel attenuator, as of the publication date of the article, was less than 30 minutes. It was hoped that by increasing the number of print heads and by using faster repetition rates, the time could be reduced to 30 seconds. This is not acceptable for clinical applications because a patient must remain absolutely still between the time the initial scan is performed, during the creation of the attenuator, and through the final scan. If the patient was to move, even slightly, the attenuation pattern would change and the image would not be properly attenuated.

What is needed is a simple device that can attenuate different regions of an x-ray signal in order to provide a clearer x-ray image of an object having variable densities.

SUMMARY

In accordance with the invention, x-ray equalization masks are prepared rapidly and economically from a first exposure of a patient, or other x-ray target object, to a beam of x-rays which, after passing through the patient, is received by an x-ray detector such as an electronic image receptor. The x-ray detector provides an output signal containing data indicating the intensity of the x-rays at all positions in the image field. This data is converted by an image processor such as a computer, wherein the intensity of the x-ray beam passing through the object or patient and striking the electronic image receptor is measured within a plurality of sub-fields (which the image field is divided into), which cover the desired image field in a two dimensional array. This information is used by the processor to determine attenuation values for each of the different pixels in the array. The attenuation values are the amount of attenuation needed to compensate for the different object or patient densities in order to create a clearer image. The processor then controls a shaping means which forms an equalization pattern in a mask. The mask is placed close to the focal spot of the x-ray beam before the acquisition of the equalized image.

The present invention comprises a processor for determining an attenuation pattern; a shaping means under control of the processor; and a equalization mask wherein said mask is pressed against said shaping means to form an equalization pattern, and placed in a path of the x-ray beam between the x-ray source and the object, such that the x-ray beam is attenuated and a clearer x-ray image is generated.

The shaping means of the present invention comprises an interface means coupled to said processor; a plurality of nickel-titanium wires coupled to said interface means, each of said plurality of wires for receiving a specific current and lengthening in response to said current; and an array of pistons coupled to said plurality of wires so that as said wires lengthen, specific pistons advance a predetermined distance.

It is not intended that the present invention be limited to the precise composition of the equalization mask. In one embodiment, the equalization mask is comprised of binding material and a rare earth metal. In the preferred embodiment, the binding material is silicone rubber and the rare earth metal is cerium oxide.

The present invention also comprises a positioning system for supporting said mask while said equalization pattern is being formed, and for manipulating said mask between a position outside an x-ray beam path and a position within said x-ray beam path.

The present invention also provides for a method for attenuating an x-ray beam image in order to provide a clearer x-ray image of an object having variable densities. The method comprises the steps of providing an x-ray source, an x-ray detector, a processor, an equalizing device and a mask; obtaining an initial low exposure image of an object; calculating an appropriate attenuation pattern based on said initial image; forming an equalization pattern in said mask; and placing said equalization pattern in a path of a regular x-ray beam between an x-ray source and the object, thereby attenuating the x-ray beam and generating a clearer x-ray image.

The step of calculating said attenuation pattern further comprises the steps of locating high and low contrast regions in said initial image; and calculating the thicknesses of said mask required to attenuate particular regions.

The step of forming said equalization pattern further comprises the steps of providing a controllable array of pistons; advancing select pistons a controlled distance in response to said attenuation pattern; and pressing said array of pistons against said mask in order to create said equalization pattern.

In the preferred embodiment of the present invention, the method for attenuating an x-ray beam image in order to provide a clearer x-ray image of an object having variable densities is performed within approximately five seconds.

GENERAL DESCRIPTION OF THE PRESENT INVENTION

The present invention provides for an apparatus that can variably attenuate different regions of an x-ray signal in order to provide a clearer x-ray image of an object having variable densities. The apparatus is intended to attenuate an x-ray beam in order to compensate for varying densities in an object such as the chest cavity of a human patient. While described herein as directed toward a chest cavity, the present invention can also be used to attenuate an x-ray image of any object having variable densities.

For work with patients, an initial low exposure image of the patient is taken in order to determine the effect of the patient's different organs on the x-ray image. A computer coupled to the x-ray detector processes the image and locates regions of high and low exposure. Based on this information, the computer is able to determine an attenuation pattern required to create a clearer image. The computer controls the advancement of select pistons in a matrix of pistons usually on the order of 8×8 or 16×16 based on the attenuation pattern. The computer is coupled through an interface means to nickel-titanium wires in order to lengthen the wires by transmitting current. The interface means can be any electrical connection (i.e. wires or cables) between the computer and the nickel-titanium wires for allowing current to flow from the computer to the nickel-titanium wires. Nickel-titanium wires are unique in that they respond to applied currents by changing their lengths. The greater the current or temperature, the shorter the wire becomes. The wires are coupled through a spring system (illustrated in FIG. 4) to the matrix of pistons so that when the current is removed from the wires, the wires stretch to their original length. The computer is able to control the advancement of the individual pistons by controlling the transmission of current to the wires. Once the pistons have been advanced, they are pressed against a blank mask of binding material and a highly attenuating compound. (The mask could alternatively be pressed against the pistons.) This forms an equalization pattern in the mask. The mask is then placed approximately at the focal point of a regular x-ray beam in order to properly attenuate the beam. The equalization mask is formed so that thicker regions correspond to previously high exposure regions and thinner regions correspond to previously low exposure regions. The entire process takes approximately 5 seconds or less because the patient must remain still during the process. If the patient moves between this short time of the initial low exposure x-ray and fmal regular x-ray, the attenuation pattern will be inaccurate and the resultant image will not be improved and will likely be degraded (i.e. have artifacts).

BRIEF DESCRIPTION OF THE DRAWINGS

FIGS. 5.1 and 5.2 show details of the actuation potentiometer.

FIG. 6 shows details of the piston actuation circuit.

DETAILED DESCRIPTION OF THE PREFERRED EMBODIMENT

The following description serves to illustrate a preferred embodiment and aspects of the present invention and is not to be construed as limiting the scope thereof.

In considering the automatic x-ray beam equalizer of the present invention some definitions are helpful. For example, "attenuation" denotes a decrease in signal intensity, in this case, x-ray beam intensity. A "shaping means" denotes any means for altering the shape of the equalization mask. By way of example only, the following disclosure utilizes an array of pistons and associated circuitry to shape the equalization mask. In one embodiment, an "equalization mask" is comprised of at least one highly attenuating compound (i.e.

a rare earth metal which has the property of being able to attenuate an x-ray photon). The preferred equalization mask also comprises a binding compound (e.g. clay). An "attenuation pattern" is a pattern of lengths each one of the array of pistons must be advanced in order to create an appropriate equalization pattern to attenuate an x-ray beam for optimal contrast and clarity. The attenuation pattern is determined by analyzing high and low exposure regions of an initial x-ray image. An "equalization pattern" is the result after the equalization mask has been positioned (e.g. pressed) against the pistons so as to form an appropriate shape for attenuating an x-ray beam.

Figure 1:
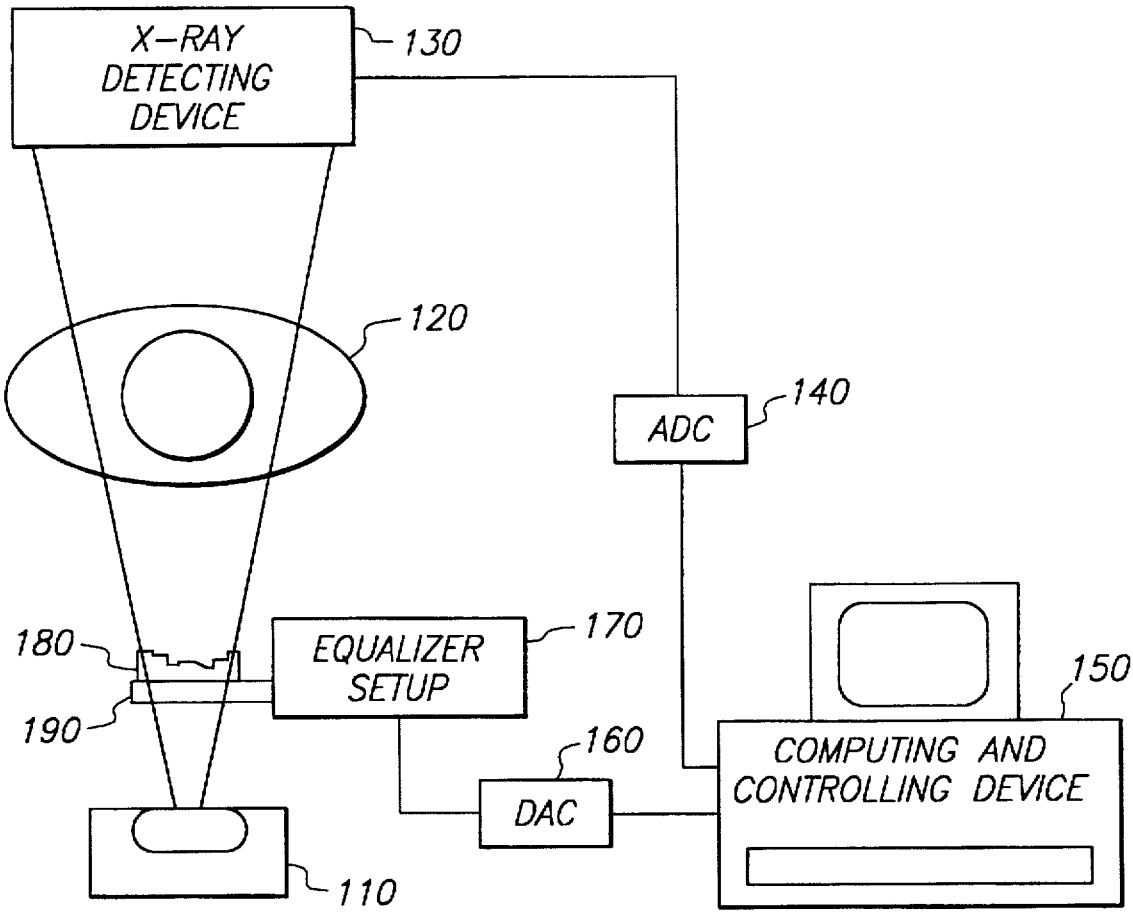
FIG. 1 shows a block diagram of the x-ray beam equalization apparatus according to the present invention.

FIG. 1 shows a block diagram of the x-ray beam equalization apparatus according to the present invention. The system comprises of an x-ray tube 110, a patient or object 120, an x-ray detecting device 130, an analog-to-digital conversion (ADC) interface 140, a computing device 150, a digital-to analog conversion (DAC) interface 160, the equalizer setup 170, and the equalization mask 180 made of attenuating materials. The equalizer setup 170 comprises those elements necessary for creating the equalization pattern in the equalization mask. The preferred equalizer setup 170 includes an array of pistons and those elements necessary for advancing these pistons (see FIG. 3 and corresponding description) and any means for supporting and moving the equalization mask 180, such as a sliding tray 190.

As an initial step, a low dose unequalized (uncompensated) image of the object 120 is acquired by the x-ray detecting device 130, without the equalization mask 180 in the x-ray beam path. The image represents a less than optimal image which illustrates the areas that require attenuation in order to generate a clearer image. The image information is digitized using an ADC interface 140, and is transferred to the computing device 150 in a digital format. The image information is converted, within the computing device 150, into digital controlling signals which correspond to the necessary attenuating material thickness. The signal is then converted to analog format, using a DAC interface 160, and is transferred to the equalizer setup circuitry 170. The equalizer set-up 170 then adjusts the positions of pistons 310 (shown in FIG. 4). An attenuating material of uniform thickness is then pressed against the pistons to generate a depth pattern on the equalization mask 180. The depth pattern is formed so that thicker regions correspond to previously high exposure regions and thinner regions correspond to previously low exposure regions. Finally, the equalization mask 180 is positioned in the x-ray field and the equalized image is acquired. The details of this process are shown in FIGS. 2–6.

Figure 2:
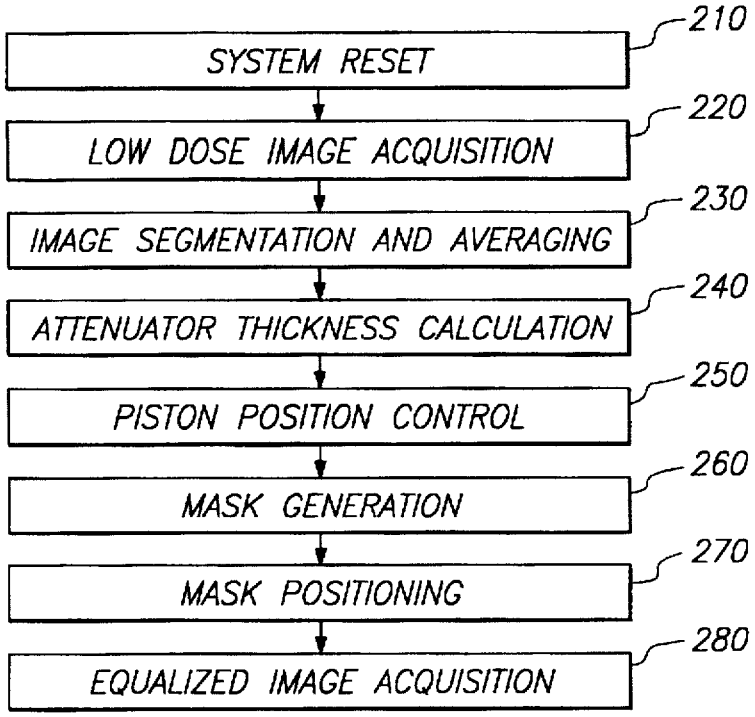
FIG. 2 shows a flow chart for the x-ray beam equalization process.

FIG. 2 shows a flow chart for the x-ray beam equalization process. At the beginning of image acquisition, a system reset 210 is performed to ensure that the attenuating material (mask) is set to a uniform thickness. This can be performed by advancing all pistons to a uniform length and pressing the attenuating material against the pistons such that the entire mask is of an even thickness. A low dose image is then acquired 220 with the equalization mask out of the x-ray field. The calculation scheme first includes an image segmentation and averaging process 230 which divides the initial uncompensated image into a matrix of square regions and finds the average gray level within each square region. The size of each region is obtained by dividing the image field size by the total number of pistons in the field. The averaged gray level information for each square region of the image is then used to calculate the required piston displacement or attenuator thickness 240. The details of mask thickness determination using the average gray level for each square piston is discussed below.

The calculated thickness information is then converted by the DAC interface 160 (see FIG. 1) into analog signals and is transferred to the piston position control 250 (see FIG. 2) which is an element of the equalizer setup 170 (see FIG. 1). After the piston positions are set according to the average gray levels, mask generation 260 (see FIG. 2) is then initiated. This is done by pressing the uniform attenuating material against the appropriately positioned pistons. The mask is then positioned into the x-ray field, using the mask positioning system 270 (a further element of the equalizer setup 170), before the acquisition of equalized image 280. The mask positioning system 270 can be any conventional electromechanical device for moving the equalization mask in and out of the x-ray beam path (e.g. a sliding tray).

Figure 3:
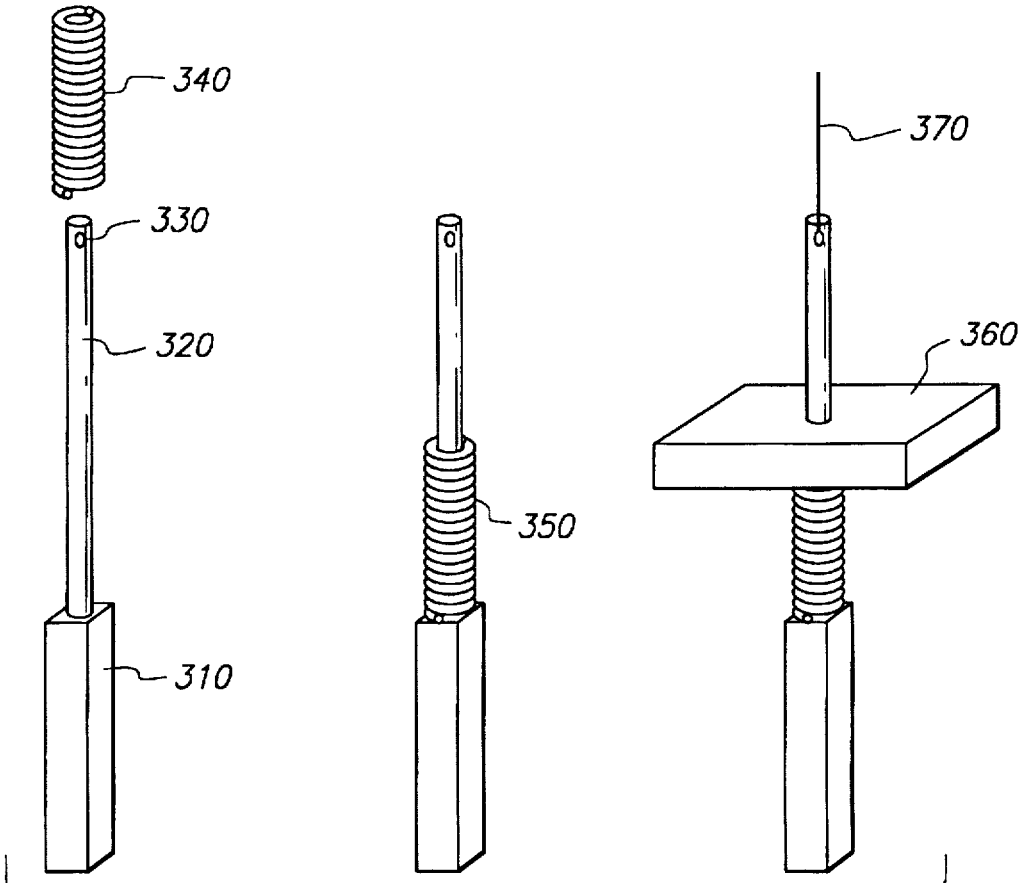
FIG. 3 shows details of the pistons in the equalization setup.

FIG. 3 illustrates the details of the pistons in the equalization setup (see FIG. 1) which are used for mask equalization generation (i.e. making the pattern in the mask). The piston head 310 is constructed using metallic square rods 310 where a certain portion of the length is machined into a cylindrical shaft 320. A small hole 330 is drilled into the shaft 320 for mounting of the nickel-titanium wire 370. (It should be noted that other mounting means may be employed) A compression spring 340 is used to provide a bias force. The inner diameter of the compression spring 340 is such that the shaft 320 can be inserted through the compression spring 340 to form a spring and piston combination 350. A metallic plate 360, with holes drilled in it, is utilized to allow the shaft of the piston 320 through but not the compression spring 340. A nickel-titanium wire is connected to the shaft of the piston through the hole 330.

The positioning process can be described as follows. Initially an appropriate current is applied through the nickel-titanium wire 370 which produces a contraction in the wire 370. The contraction of the wire 370 will displace the shaft 320 and the head 310 of the piston relative to the metallic plate 360, which is fixed, and therefore compress the compression spring 340. The displacement depends on the current that is applied through the wire 370 and can be controlled through a feedback loop. The design for the feedback loop mechanism is described later in FIGS. 4, 5 and 6. Only one piston is shown in this figure in order to assist the understanding of the concept. However, in the practical situation there will be a matrix of multiple pistons (see e.g. FIG. 4) aligned to perform the mask generation task. The size of the matrix will depend on the resolution desired (e.g 8×8, 16×16).

Figure 4:
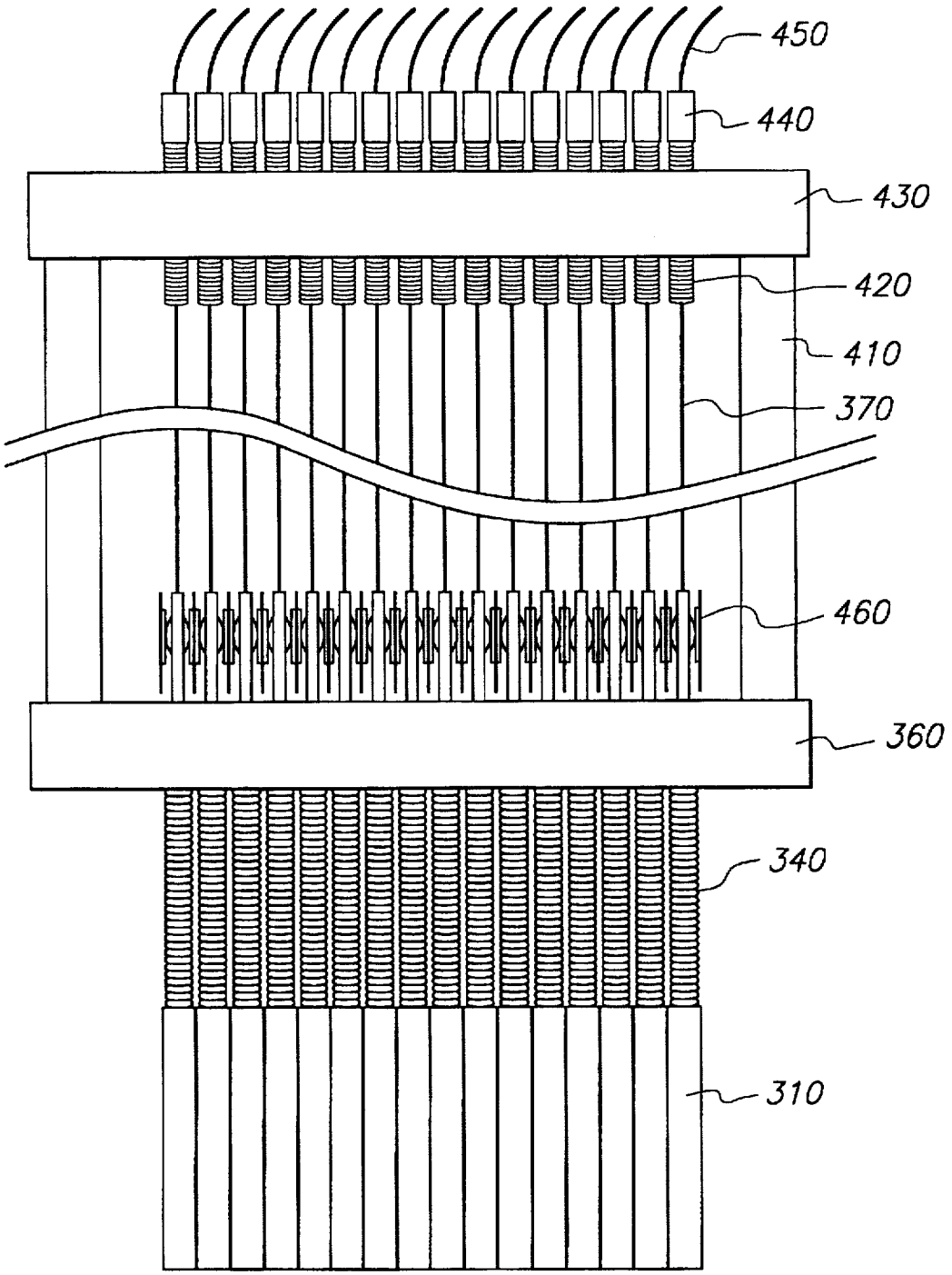
FIG. 4 shows a side view of the piston positioning mechanism.

FIG. 4 illustrates a side view of the piston positioning mechanism contained within the equalizer setup 170 (see FIG. 1). The piston head 310, compression spring 340, metallic plate 360, and the nickel-titanium wire 370 have been described previously and therefore will not be discussed in detail here. A metallic plate 360 and an insulating plate 430 are supported by stainless steel rods 410. The wires 370 are held by screws 420 that are mounted through the insulating plate 430. The appropriate tension on the wires 370 can be obtained by adjusting the screws. A conducting connector 440 and conducting lead 450 provides electrical connection for the screws 420 and nickel-titanium wires 370, and allow for current transfer in order to adjust the length of the wires. A heating circuit (not shown) is utilized to provide current, thereby heating the wires to lengthen or contract them. In the heating circuit, which will be described in more detail in FIG. 6, the metallic plate 360 is set to ground level, each wire is heated through its individual connector and the heating circuit. The actuation of piston head 310 is realized through potentiometers 460 by which the height or position of the pistons 310 can be sensed and used through a feedback loop.

FIG. 5 shows the details of the actuation potentiometer 460 in FIG. 4. In FIG. 5-1, two insulating plates 510 are coated with conducting plastic layers 520 with known resistance and are positioned in parallel to the piston shaft 320. Electrical connections to the circuit are provided through the wires 530. Two flat spring brushes 540 are mounted near the tip of the piston shaft 320 to provide electrical contact with the conducting plastic layers 520. These two flat spring brushes 540 are electrically connected and physically held in position by a metallic ring 550. The metallic ring surrounds the piston shaft 320 but is electrically insulated from it by a ceramic ring 560.

The effective circuit of the potentiometer of FIG. 5-1 is shown in FIG. 5-2: Two identical resistors R are connected by the flat spring brushes 540 (see FIG. 5.1) represented in FIG. 5-2 by the arrow. As the position of the flat spring brushes 540 changes, the resistance across point A and point B changes accordingly. The change of resistance can then be detected by the computer and used in the feed back loop circuit (not shown) for piston position control.

FIG. 6 shows the details of the piston actuation circuit. The circuit for only one piston is shown and it is understood that the circuit for the other pistons are similar. Although the present invention is described using the following actuation circuit, it should be noted that other well known circuits for performing the same functions can also be utilized.

In this circuit, the potentiometer is depicted schematically as element 640 in FIG. 6; it is the same potentiometer that was shown mounted on the top of the piston shaft 320 in FIG. 5. The resistor 670 represents the resistance of the nickel-titanium wire 370 in FIG. 4. After the computing and controlling device 150 (see FIG. 1) calculates and converts the desired attenuator thickness or piston position into a corresponding signal, it is then transferred to a digital latching element 600 and a DAC interface 610. The purpose of positioning the digital latching element 600 before the DAC interface 610 is to maintain the digital signal in place so that the converted analog signal is kept constant. The analog output current (not shown) is converted into a voltage signal (not shown) by the converting resistor 620 and is connected to the non-inverting input (+) of the operational amplifier 630. The non-inverting input (+) of the operational amplifier 630 is compared with the voltage from the piston potentiometer 640 in order to perform feed back loop operations. The piston potentiometer 640 and the reference voltage $V_{ref}$ are used for calibration in order to get a desired range of piston positions for a certain DAC interface 610 output voltage range. During the piston positioning operation, if the output voltage from the potentiometer 640 is different from the non-inverting input voltage of the operational amplifier 630, the operational amplifier 630 will drive the power transistor 650 to increase or reduce the current through the nickel-titanium wire represented in FIG. 6 as resistor 670, such that the resultant nickel-titanium wire length or corresponding piston position provides the desired output voltage from the potentiometer 640.

Average image gray level is used for determination of the desired piston position or attenuator thickness. In an ideal condition, the relationship between incident, $I_O$, and transmitted, I, intensity through an attenuating mask can be written as:

$$I = I_o e^{-\mu_m^{eff} t_m} \tag{1}$$

Where $t_m$ is the attenuator thickness and $\mu^{eff}_m$ is the effective linear attenuation coefficient of the attenuating mask.

The attenuator thickness can be calculated using equation 1:

$$t_m = \frac{\ln\left(\frac{I_o}{I}\right)}{\mu_m^{eff}} \tag{2}$$

In the above equation, $t_m$ is the required attenuator thickness to compensate for a certain gray level I to the desired gray level $I_{min}$. The value can be measured at a particular beam energy using a calibration phantom with different thicknesses of the attenuating material. A calibration phantom is a calibration device that incorporates attenuating material of different thicknesses. It is used to determine the amount of attenuation that different thicknesses of the attenuating material will generate.

The attenuating mask 180 can be made by mixing a deformable binding material. In the preferred embodiment, this binding material is silicone rubber (Depco Inc. Silicone Rubber packing Hauppauge, New York) with cerium oxide ($CeO_2$). A 1 cm thickness of a mixture of 15 g of $CeO_2$ with 55 $cm^3$ of silicone rubber produces a dynamic range of 10 in a 65 kVp image (where kVp is the peak x-ray tube potential). In other words, this concentration of mask requires a piston travel of 1 cm in order to compensate for a dynamic range of 10 in an image. Depending on the intended application, other x-ray attenuating materials can also be used. The choice of the x-ray attenuating material is determined by its effect on the x-ray spectrum.

In the computing and controlling device 150 the dynamic range, D, is calculated using the following formula:

$$D = I_{max}/I_{min} \tag{3}$$

Where $I_{max}$ and $I_{min}$ are the maximum and minimum average pixel values in the image.

The above operations can be performed using a look-up table where the average gray level is used as an input and the output value is proportional to the attenuator thickness for each piston location.

Finally, after the mask is generated, it is indexed into proper position in the x-ray beam before the fmal equalized image is acquired.

From the above, it is clear that the present invention provides for quick and variable attenuation of different regions of an x-ray signal in order to provide a clearer x-ray image of an object having variable densities.

We claim:

1. A method of attenuating an x-ray beam, comprising the steps of:

a. providing an x-ray source, an x-ray detector, an object, a processor, a plurality of nickel-titanium alloy wires coupled to an array of pistons, an interface means coupling said wires to said processor, and a mask;

b. obtaining an initial image of said object using said x-ray source and said x-ray detector;

c. calculating an appropriate attenuation pattern based on said initial image with said processor;

d. forming an appropriate equalization pattern in said mask by i) advancing select pistons among said array of pistons with said nickel-titanium wires under control of said processor, and ii) pressing said array of pistons against said mask in order to create said equalization pattern in said mask; and e. placing said mask in a path of the x-ray beam between said x-ray source and said object, such that the beam is attenuated.

2. The method of claim 1, wherein said step of calculating said attenuation pattern further comprises the steps of:

a. locating different regions of exposure in said initial image; and b. calculating thicknesses of said mask required to attenuate said different regions of exposure.

3. An apparatus for attenuating an x-ray beam originating from an x-ray source, passing through a patient and detected at an x-ray detector, comprising:

a. an x-ray source for projecting an x-ray beam in a path through a patient;

b. an x-ray detector for detecting said x-ray beam;

c. a processor for processing data from an initial x-ray scan and locating high and low exposure regions;

d. an array of pistons under control of said processor, wherein said processor controls advancement of select pistons corresponding to said high and low exposure regions in the initial scan;

e. a plurality of nickel-titaniun alloy wires coupled to said array of pistons;

f. an interface means for coupling said wire's to said processor, whereby said processor controls an application of specific currents to specific wires which respond by lengthening and advancing said wire's corresponding piston a predetermined distance; and g. an equalization mask wherein said mask is i) pressed against said pistons to form an equalization pattern, and ii) placed in a path of said x-ray beam between said x-ray source and the patient, such that said beam is attenuated.

4. The apparatus of claim 3 wherein said equalization mask is comprised of binding material and a rare earth metal.

5. The apparatus of claim 3 wherein said binding material is silicone rubber and said rare earth metal is cerium oxide.

6. The apparatus of claim 3 further comprising a positioning system for supporting said mask while said equalization pattern is being formed and for manipulating said mask between a position outside said x-ray beam path and a position within said x-ray beam path.

* * * * *